US005762656A

United States Patent [19]

Burke et al.

[11] Patent Number: 5,762,656

[45] Date of Patent: Jun. 9, 1998

[54] DENSE CORE CHARCOAL BRIQUET

[75] Inventors: Kelly M. Burke; Jeffery P. Caddell, both of Livermore, Calif.

[73] Assignee: The Clorox Company, Oakland, Calif.

[21] Appl. No.: 667,186

[22] Filed: Jun. 20, 1996

Related U.S. Application Data

[60] Provisional application No. 60/000,357, Jun. 20, 1995.

[51] Int. Cl.[6] ..... C10L 5/36

[52] U.S. Cl. ..... 44/589

[58] Field of Search ..... 44/589, 590, 591, 44/593

[56] References Cited

U.S. PATENT DOCUMENTS

| | | | |
|---|---|---|---|
| 1,668,660 | 5/1928 | Shimamoto | 44/550 |
| 2,341,377 | 2/1944 | Hinderer | 44/550 |
| 2,916,365 | 12/1959 | Smith | 44/530 |
| 3,352,651 | 11/1967 | Davidson | 44/10 |
| 3,356,469 | 12/1967 | Stephenson et al. | 44/6 |
| 3,492,134 | 1/1970 | Brummendorf | 44/530 |
| 3,527,580 | 9/1970 | Bonlie | 44/11 |
| 3,726,652 | 4/1973 | Schick | 44/14 |
| 4,412,840 | 11/1983 | Goksel | 44/10 |
| 4,478,601 | 10/1984 | Stephens | 44/14 |
| 4,496,366 | 1/1985 | Peters | 44/14 |
| 4,818,249 | 4/1989 | Barrett, Jr. | 44/535 |
| 5,427,805 | 6/1995 | Crace | 44/550 |

*Primary Examiner*—Jacqueline V. Howard

*Attorney, Agent, or Firm*—Sharon R. Kantor; Michael J. Mazza

[57] ABSTRACT

A solid fuel briquet, such as a charcoal briquet for cooking, which displays selected ignition and burn characteristics over a variety of shapes and compositions, as well as a method for forming such a briquet, are provided. The briquet is defined by an ignition phase of less than about 18 minutes, preferably less than about 15 minutes and a burn phase of greater than about 35 minutes, preferably 40 minutes and most preferably 45 minutes, with respect to any desired briquet shape. The briquet is made by predensifying a coal portion of the briquet into pellets. The pellets are then blended with wood char and any other optional ingredients and compacted into briquets. The resulting briquet contains dense coal regions, surrounded by regions of char and any adjunct briquet ingredients.

14 Claims, 1 Drawing Sheet

DENSE CORE CHARCOAL BRIQUET

BACKGROUND OF THE INVENTION

This application claims the benefit of U.S. Provisional Application No. 60/000.357, filed 20 Jun. 1995.

1. Field of the Invention

This invention relates to the field of charcoal briquets and other solid fuel compositions in briquets or other geometric configurations, and more particularly to the density and material distribution and configuration to achieve desired lighting and burn characteristics with respect to intended uses such as barbecue cooking. The most common examples of such fuel compositions are charcoal briquets which include coal and comminuted char of various vegetable materials, such as wood, hulls, pits, and other agricultural waste material that is mixed with a binder and rolled, pressed or otherwise formed into briquets. However, the present invention has application to other solid fuel compositions, such as comminuted wood or organic materials that are rolled, pressed or extruded into pellets, discs, briquets or other shapes.

2. Brief Statement of the Related Art

Charcoal briquets presently available are typically provided in a "pillow" shape which provides for reasonably satisfactory ease of manufacturing by the supplier and handling by the consumer. However, little attention has been paid to their burning characteristics as related to their configuration and material distribution. As is well known, such briquets are typically used for cooking on a grill or the like by preparing a multiplicity of briquets in a mounded configuration, igniting their surface by some ignition means such as lighter fluid, electric heaters, etc., and waiting until ignition of a significant portion of the briquets has progressed until a majority of the exposed surface is ignited and burning has progressed inwardly toward the interior of the briquet. As burning proceeds inwardly from the surface of the briquet, a gray ash is formed thereon. Thus completion of the initial "ignition phase" of burning is identifiable by the formation of such visual ash on the briquet, and is defined herein as the time at which there is 60–75% visual ash formation on the briquets. Thereafter the briquets are typically spread under a grill or the like for cooking, and they continue to burn with an intense heat throughout a "burn phase". For maximum performance of such briquets it is desirable that the ignition phase be rapid so that the briquets may be used for cooking without undue delay, and that the burn phase be extended to provide adequate cooking time for the use intended. It is further desirable to obtain such beneficial combustion performance in the most efficient manner with respect to the amount of fuel consumed.

There have been very little prior art developments related to design of solid fuel articles for desired combustion performance. There has been some work at ornamental configuration of fuel briquets, as well as geometrical configuration of briquets to enhance ignition or burning by enhancing air supply, such as provision of external surface discontinuities such as ribs, flutes, groups, slots or the like, and internal openings and passages of various configurations. Such attempts may enhance commencement of ignition or overall combustion, but do not provide desired optimal ignition and burning characteristics.

Other fuel briquets intended for very rapid ignition and delivery of intense heat provided a combination of powdered metal and oxidizers in a charcoal briquet having a higher ratio of surface area to volume and/or weight. However, very rapid delivery of intense heat does not provide an acceptable combustion response for cooking purposes, and such prior art suggestions have made no attempt to quantify or optimize such ratios. Other prior art briquets have recognized that the surface area to volume ratio of the briquet may affect ignition and burn characteristics and should be increased to provide rapid ignition and burning. However, such ratios have not been employed to design a briquet providing optimal desired ignition and burning characteristics. Layered briquets, having an easy lighting outer layer and long burning inner layer have been disclosed, but can not be commercially manufactured without loss of layer integrity.

Accordingly, it is an object of the present invention to provide a briquet which provides desired ignition and burn phase characteristics including a maximum ignition phase of less than about 25 minutes, followed by a sustained burn phase of greater than 35 minutes.

Another object of the present invention to provide such a briquet with desired ignition and burn phase characteristics regardless of specific composition, raw materials, geometric shape, size, or other manufacturing parameters which may be affected by supplies and economic considerations in the supply market.

A further object of the present invention is to provide a briquet with the desired ignition and burn phase characteristics which does not require the addition of ignition aids of a formula change.

SUMMARY OF THE INVENTION AND OBJECTS

The present invention provides a solid fuel briquet for cooking, such as a charcoal briquet, which displays selected ignition and burn characteristics over a variety of shapes and compositions, as well as a method for forming such a briquet. Thus, the present invention provides a briquet which provides an ignition phase of less than about 18 minutes, preferably less than about 15 minutes and a desired burn phase of greater than about 35 minutes, preferably greater than about 40 minutes, and more preferably greater than about 45 minutes with respect to any desired briquet shape. The foregoing results are obtained by predensifying the coal portion of the briquet into pellets. These pellets are then blended in with the wood char, and compacted into briquets. The resulting briquet contains regions of dense coal surrounded by regions of char and any adjunct briquet ingredients.

DEFINITIONS

Figure 1:
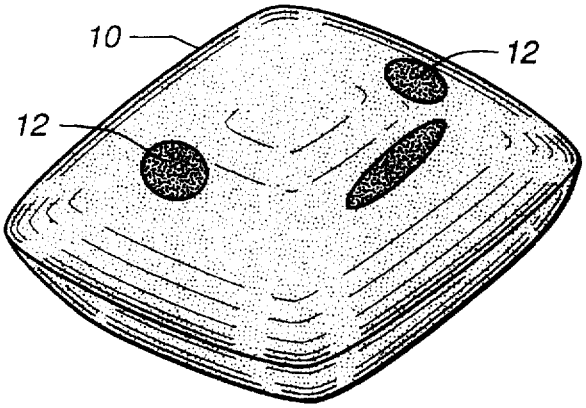
FIG. 1 is a perspective view of a pillow briquet embodying the present invention.

In this document, use shall be made of the following terms of art, which have the meanings as indicated below.

The term "Binder" as used herein refers to complex carbohydrates that possess adhesive qualities to produce or promote the holding together of loosely aggregated components as in a briquet. Examples of binders include starches such as corn starch, etc.

"Coal" as used herein refers to a solid combustible substance formed by the partial decomposition of vegetable matter without free access of air and under the influence of moisture and often increased pressure and temperature that is widely used as a natural fuel. It is further understood that coal includes substances such as the foregoing either before or after partial burning and/or scorching in an oxygen-poor environment (or charring) such as might be carried out to remove undesirable components, an example of which is sulfur. It is therefore understood that designations such as lignite and lignite char, anthracite, semi-anthracite, bitumen, mineral carbons and mixtures of any of the foregoing, as well as any partially burned or scorched portions thereof, may singularly or collectively be referred to herein as coal.

The term "Ignition Aid" as used herein refers to materials that are useful in the act or process of initiating the oxidation or combustion of a fuel mixture or mixture of other objects, such as one or more briquets. Examples of ignition aids that are consistent with the meaning of this term as used herein include sawdust and other particulate cellulosic matter as well as mixtures thereof, solvents such as aliphatic and petroleum hydrocarbons and blends thereof; etc.

"Optional adjuncts" as used herein refers to components which may be desirably included in a briquet formulation to enhance appearance or aesthetic use qualities thereof. Examples of optional adjuncts include: builders; fillers; density modifiers; ash whiteness enhancers; release agents, etc., as well as combinations of any of the foregoing. A typical builder includes limestone, and borax as well as various hydrates of the boron oxides can be used for dual purposes as release agents and/or builders. Limestone and borax decahydrate are preferred optional adjuncts.

As used herein, the term "Oxidizer" is understood to refer to any material or component which can effectively increase the supply of oxygen to combustible ingredients of the formulation. Alkali metal nitrates are examples of preferred oxidizers.

The term "Wood Char" as used herein refers to the hard fibrous substance consisting basically of xylem that makes up the greater part of the stems, branches and roots of trees or shrubs beneath the bark and is found to a limited extent in herbaceous plants and which has been partially burned or scorched or otherwise converted to carbon to some extent. Wood char is a comprehensive term and includes retort chars, kiln chars, etc.

DETAILED DESCRIPTION OF THE PREFERRED EMBODIMENTS

Charcoal briquets and the like are employed by leaving a multiplicity of briquets initially mounded into a pile for better ignition. The combustion of such briquets is resolvable into an initial "ignition" phase which begins with the commencement of ignition and proceeds until the briquets are ignited over substantially their entire surface, and a "burn" phase in which combustion continues to proceed from the exterior surface of the briquet to the interior. At this time there is a significant rise in the temperature and heat generated by the burning briquets. This transition from the ignition phase to the burning phase can be identified by a layer of gray ash which forms on the surface of the briquet after initial burning at the surface.

For purposes of illustrating the present invention, the end of the ignition phase is defined as the time, in minutes, at which a majority of the surface of the briquets display a visual ash. As understood herein, the time required to achieve a certain amount of visual ash cover is regarded as the "ash time" or AT. The amount of ash that has been found to be a convenient tool for evaluation purposes, expressed as a percent of total briquet surface area, is approximately 60–90% visual ash cover, and more preferably 70–80% visual ash cover. These values may be written as 60–90% AC and 70–80% AC, respectively. The length of time which has been found to be convenient for use in evaluating the ash appearance on briquets is approximately 5–20 minutes following ignition, and preferably 10–15 minutes following ignition. According to one preferred embodiment of the present invention, it is desired that 70% AC occurs within less than about 18 minutes, and preferably less than about 15 minutes after commencement of ignition of the charcoal briquets. It is to be understood that size, weight and composition can all influence ignition and burn phase characteristics of briquets. One prior technique for optimizing burn characteristics based on shape configuration has already been described in U.S. Pat. No. 4,496,366 to Peters, which is also assigned to the assignee of the present invention, and is incorporated by reference herein. However, none of the prior art teach or suggest optimization of burn characteristics based on a redistribution of the raw materials already present in a briquet formulation. Thus, for purposes of providing a convenient and relatively consistent basis for comparison, briquets that were evaluated in the course of the present invention were approximately pillow-shaped in configuration, and weighed approximately 25 g. It is to be understood that the technique of the present invention can also be employed to design charcoal briquets with other ignition and performance characteristics, if so desired.

Upon completion of an initial ignition phase, briquets are normally spread out upon a planar surface beneath a grill or other cooking surface or the like. During the subsequent burn phase, the briquets continue to burn with an intense heat for a period of time, during which they are employed for purposes such as cooking or the like. The total amount of time, in minutes, from ignition of the briquets until the briquets are useful for cooking is referred to as the "time to heat," or TTH. Values for TTH can be rather arbitrary, as they can vary depending upon the subjective temperature range and/or the degree of "doneness" desired for a food item, the nature of the item being cooked, etc. Consequently, it is convenient to select a temperature to be used in determining TTH values. In general, the temperature range over which cooking with briquets is most commonly associated varies from about 135° C. (275° F.) for rare or raw cooking to about 250° C. (approx. 480° F.) for well-done cooking. Thus, according to one embodiment of the present invention, TTH values are preferably evaluated within the range of about 135°–250° C. (approximately 275°–480° F.), more preferably 150°–230° C. (approx. 300°–445° F.), and most preferably about 180°–220° C. (approx. 355°–430° F.). According to a preferred embodiment of the present invention, time to heat values can conveniently be determined for temperatures between about 190°–195° C. (approx. 375°–385° F.). Within this temperature range, it is desirable that the TTH be less than 30 minutes, preferably less than 25 minutes, and more preferably less than about 20 minutes.

Another important aspect of briquet performance is the amount of time for which the burn phase configuration or composition can sustain a cooking temperature, i.e., the time available for cooking, or "cook time" (CT). A briquet that ignited readily and gave rise to short ash times, for instance, would be desirable in that cooking could conveniently commence relatively quickly following ignition. However, if such a briquet was to become consumed too rapidly, it would not be acceptable for providing a fuel source for sustained cooking. Therefore the "cook time" (CT) associated with a briquet is defined for the purposes herein as the time from commencement of the ignition phase until the briquets have lost approximately one-half of their initial weight. According to one preferred embodiment of the present invention, it is desired that CT have values comprising a minimum of 35, preferably 40, and more preferably 45 minutes. However, it is again to be understood that the present invention may be employed to provide briquets with any other desired cook time characteristics.

The present invention provides a briquet having a desired ignition phase and burn phase regardless of the shape of the briquet, by designing the distribution of briquet materials to provide such a combustion response. More particularly, the present invention is concerned with briquets that exhibit regions of different densities: a first, higher density region; and a second, lower density region; such that the overall composition of the briquet is unchanged from the prior art. By varying the densities and compositions of the different regions relative to one another, different ignition and burn characteristics for the briquets may be realized. On a microscopic level, the higher density regions reflect material of higher density, greater compaction, etc., during production than the lower density region. On a macroscopic scale, the overall composition of the briquet is unchanged from that of the prior art. The invention is therefore primarily concerned with the redistribution of materials within briquet formulations, and the advantages that can be realized through selective redistribution of the initial ingredients.

Briquets are typically predominantly comprised of two components: wood char, which is relatively easy to ignite but combusts rapidly, and coal, which is more difficult to ignite and burns more slowly than wood char, but which also burns at higher temperatures. Wood char is produced either in concrete kilns or retort furnaces where wood is placed and a portion of the wood is burned in an atmosphere that is made deficient in available oxygen by restricting the airflow. The reduced oxygen atmosphere prevents complete combustion of the wood, allowing the production of char which has been depleted of the more volatile materials (which cause smoke) but which still contain most of the carbon, which provides the primary cooking source for the briquets.

In briquets of the art, wood char is combined with coal, binders and other components. The latter comprise ignition aids and/or optional adjuncts, which may include some or all of the following: sawdust, alkali metal nitrates, fillers, density modifiers, ash whiteness enhancers and solvents, etc. These ingredients are blended together and then mixed in a large mixer with a cooked and thickened binder, such as a starch slurry, which acts to hold all of the other materials together. The mixture is then formed into the desired shape by rolling, extruding, pressing, etc. In a typical rolling process, the mixture is fed into a large roll press in which two large rotating shafts having drum cylinders with pockets on them squeeze the material into briquets of a configuration that is determined by the shape of the pockets. These briquets are then dried in large tunnel dryers where they are piled on large perforated wire belts and hot air is blown through the belts and briquets to dry off excess moisture that was added in the starch slurry. This step hardens the starch binder so that the briquets achieve a higher strength to enable them to be handled, packaged and shipped. The briquets are then packaged in standard bag filling equipment.

In the present invention, a coal portion is predensified into pellets through the use of a compacting means, such as an agglomerating roll press, extruder, disc pelletizer, or an agglomerating device that acts to increase both the density and apparent unit size of the product. The dense coal pellets are then blended with wood char or undensified lignite char and compacted into charcoal briquets using a roll press with the use of starch or another binder. The overall formula of the briquet is unchanged from that of a charcoal briquet of the art made without the use of densified pellets, however, there is a difference in material distribution and density profile. Thus, the coal portion that is predensified may be comprised of coal along with any of the remaining briquet ingredients, either as to the entirety of a particular ingredient or any percentage thereof. The resulting briquets are thus referred to as "dense core" briquets, which designation refers merely to the variation in density profile within the bulk of the briquet, and is in no way meant to indicate any one preferred cross-sectional distribution for the different density regions.

Figure 3:
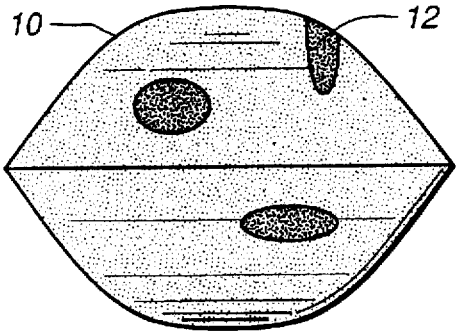
FIG. 3 is a side view of the briquet of FIG. 1.
Figure 2:
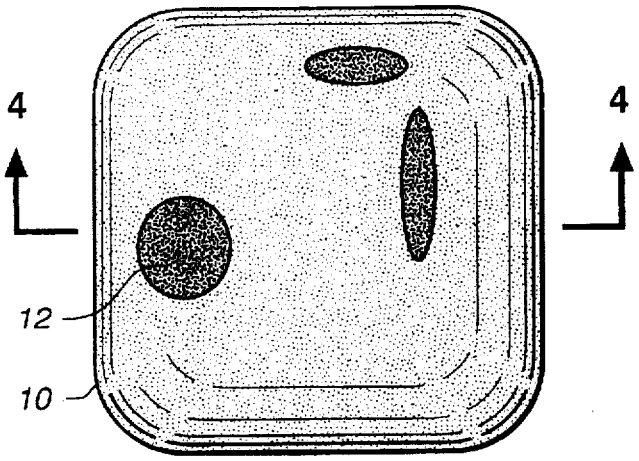
FIG. 2 is a top plan view of the briquet of FIG. 1.
Figure 4:
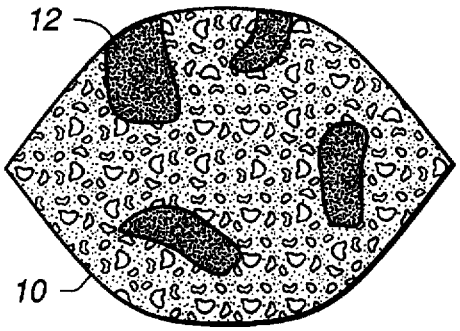
FIG. 4 is a sectional plan view of the briquet of FIG. 2, taken along line 4–4.

Referring now to the drawing Figures, there is shown a briquet 10 having regions of densified coal 12, distributed throughout. Some of the regions of densified coal 12 appear on the surface as depicted in FIGS. 1–3, however the densified coal regions 12 are preferably located within the briquet 10, as depicted in FIG. 4. The use of the densified coal pellet of the present invention results in a higher percentage of wood char portion at the surface of the briquet which improves both the ease of lighting and time to heat (TTH), while the densified coal pellets prolong the length of the burn and therefore the amount of time that the briquets are available as a fuel source for cooking (CIT). Generally, at least about 25% of the coal, preferably about 50%, more preferably 90% and most preferably about 100% of the coal is densified and concentrated as pellets within the briquet. The pellets may be formed into virtually any size and shape, depending on the equipment available for manufacturing, as well as the heating and cooking performance characteristics desired for the briquet products.

The following examples serve to further illustrate some of the surprising performance benefits of the various aspects of the inventive charcoal briquets.

EXPERIMENTAL

Four examples of preferred formulations for the inventive dense core charcoal briquets were prepared having the formulations indicated in Table I below.

TABLE I

| | Briquet Composition in Weight Percent (Dry Basis) | | | |
|---|---|---|---|---|
| Raw Material | EXAMPLE I | EXAMPLE II | EXAMPLE III | EXAMPLE IV |
| Retort Chars | 22.8 | 44.2 | 34.4 | 35 |
| Kiln Chars | 0 | 11.3 | 11.3 | 15 |
| Coal | 60 | 30 | 39.7 | 30 |
| Binders | 5.2 | 4.7 | 4.8 | 5.5 |

TABLE I-continued

| Raw Material | EXAMPLE I | EXAMPLE II | EXAMPLE III | EXAMPLE IV |
|---|---|---|---|---|
| | Briquet Composition in Weight Percent (Dry Basis) | | | |
| Ignition Aids | 4.0 | 1.8 | 1.8 | 3.0 |
| Oxidizers | 3.0 | 1.5 | 1.8 | 2.0 |
| Optional Adjuncts | 5.0 | 6.5 | 6.5 | 9.0 |

In general, it is believed that any shaped briquet within the ranges indicated for Example V in Table II below is effective for the purpose of this invention:

TABLE II

| Raw Material | EXAMPLE V |
|---|---|
| | Briquet Composition in Weight Percent (Dry Basis) |
| Retort Chars | 20.0–50.0 |
| Kiln Chars | 0.0–20.0 |
| Coal | 25.0–65.0 |
| Binders | 3.0–7.5 |
| Ignition Aids | 0.0–20.0 |
| Oxidizers | 0.0–5.0 |
| Optional Adjuncts | 0.0–15.0 |

EXAMPLE VI

In Example VI, a series of experiments were conducted in order to evaluate the burn performance of dense core charcoal briquets prepared according to the teaching of the present invention. Thus, various briquets were made that contained the ingredients and total amounts as indicated above in Table I, Example IV, with the difference being the coal distribution within the briquet as described herein. Formula IV-A incorporated one-third of the total coal in the form of dense core pellets in the bulk of the briquet, Formula IV-B two-thirds, and Formula IV-C incorporated all of the coal as dense core pellets in the briquet. For comparison purposes, a control briquet ("Control") was used that contained a homogeneous mixture of the ingredients of Example IV.

Burn performance of the Control as well as Formula IV-A, IV-B and IV-C briquets were evaluated as follows. A two pound pile of briquets were prepared and placed in a burn vessel comprising an outer solid cylinder and inner mesh cylinder, with an air space therebetween. One fluid ounce of solvent per pound of briquets was applied and the briquets ignited. Temperatures were measured by thermocouples placed over the burn vessel after cessation of flames, the latter determined by visual observation. The time required for approximately 65–75% ask to cover the surface of the briquets (ash time, or AT) was noted following commencement of ignition. The percent of visual ash on the surface of the briquets, or ash cover, was noted at ten minutes after commencement of ignition. Eight such burns of each briquet were made in a random order. Table III contains the results of such tests.

TABLE III

Results of Burn Tests for Briquets With and Without Dense Core Pellets of Varying Amounts of Coal

| Attribute: | Control | Formula IV-A | Formula IV-B | Formula IV-C |
|---|---|---|---|---|
| Wt. % Coal in Pellet | 0.0% | 33.3% | 66.7% | 100.0% |
| AT[a] (min.) | 23.3 | 21.4 | 19.2 | 18.3 |
| TTH[b] (min.) | 25.3 | 21.2 | 18.3 | 17.5 |
| AC[c] (%) | 27.3% | 32.0% | 37.7% | 39.5% |
| | | ±1.9 | ±3.1 | ±0.8 |
| CT[d] (min.) | 36.0 | 35.7 | 45.3 | 38.0 |
| | | ±10.7 | ±14.6 | ±6.0 |
| Peak Temperature[e] in °C. (°F.) | 217.6 (423.6) | 216.8 (422.2) | 226.4 (439.5) | 222.6 (432.6) |

[a]AT = Ash Time. Used here to evaluate the time for 65–75% of the briquet to be covered with ash.
[b]TTH = Time to Heat. Here, the amount of time to reach about 193° C. (380° F.).
[c]AC = Ash Cover. The percent of visual ash, which here was determined at 10 minutes after ignition of the briquet.
[d]CT = Cook Time. Here, the amount of time that the briquet temperature was above 193.3° C. (380° F.).
[e]Peak Temperature = maximum temperature reached at the surface of the briquet, in °C. (and °F.).

Referring to Formula IV-C, it can be seen that the ignition phase of the briquet, as shown by AT (the time to achieve approximately 65–75% visual ash cover) and TTH (the time required to reach a temperature of approximately 193° C. (380° F.)), was complete within about 18 minutes, as compared to about 23–25 minutes for the Control. Surprisingly, it was found that within ten minutes from ignition, there was approximately a 12% increase in AC—from about 27% for the Control to about 39% for Formula IV-C—when all the coal was concentrated in pellet form. Another advantage of incorporating the dense coal pellets into the briquet that can be noted is that samples corresponding to Formulas IV-B and IV-C of the present invention appeared to reached a higher peak temperature than the Control samples. Turning now to the duration of the burn phase, as shown by CT (cook time, or time spent over approximately 193° C. (380° F.), although it did not show a definite increase for Formulas IV-B and IV-C as compared to the Control, it is noteworthy that there appears to have been no significant decrease. Although CT did not increase, the fact that higher temperatures were achieved for the inventive pellets nonetheless suggests that cooking could take place in shorter time. Thus, as the formulas in Example VI indicate, it is possible to provide a dense core pellet that can provide a variety of positive benefits as far as ignition times and time for food cooking preparation as compared to prior art briquets.

Overall, it was noted that the maximum benefit to AC and TTH in Example VI occurred where as much coal as possible had been incorporated into the pellets. The above tests were carried out with coal pellets and briquets prepared using pre-manufacturing equipment. It is thus anticipated that longer burn phases, and more readily discernible benefits for CT, may be realized where pellet-containing briquets are produced under greater compaction during formation such as might be available during manufacturing processes.

EXAMPLE VII

In one series of experiments that were conducted, it was found that coal pellets could be produced that exhibited densities ranging from approximately 0.84 g/cc to 0.98 g/cc and even as high as 1.2 g/cc. By comparison, the density of some prior art briquets was typically found to be about 0.75 g/cc. Upon incorporating the dense pellets and the remaining ingredients into various briquet conformations and configurations, it was determined that the improved ash time (AT) and time to heat (TTH) parameters were observed for briquets that had dense coal pellets closer to the core of the briquets. Without being bound by theory, one possible explanation for this phenomenon is that the comparative lower densities of the remaining briquet ingredients enables the latter ingredients to be more readily ignited at the surface of the briquet (thus giving rise to shorter ash times, AT), while simultaneously providing a heat source for the denser coal pellets at the interior of the structured briquet. Thus, a more intense and concentrated source of heat can be applied towards the interior portions of the briquets where the dense coal pellets preferably reside, thus enabling their burning at higher temperatures than prior art briquets. These results suggest that briquets with different burn characteristics may be prepared by selective placement of the pellets within the bulk of the briquet. Accordingly, in one preferred embodiment of the invention, dense coal pellets are located within the interior of the structured briquet, as opposed to being randomly distributed throughout the bulk of the briquet.

EXAMPLES VIII–XI

Examples VIII–XI study the effect of employing different amounts of ingredients from the total briquet composition in the dense pellet portion. In other words, the total composition of all the briquets used in Examples VIII to XI was the same, and corresponds to a formula consistent with that presented in Table II above. Only the composition of the pellets was allowed to vary as a percentage of the overall total composition of the briquet. By way of example then, if the total composition of the control briquet contained 4.8% binder and the amount of binder which was used in the pellet was 3.0%, then the total amount of binder used in the pellet would be 4.8%×3.0% or approximately 0.14% of the total binder in the briquet. The results of comparison burn tests for briquets containing the pellets of Examples VIII–XI are given in Table IV below, where the "Control" entries are for the homogeneous briquet with no significant variation in composition along a cross-section of the briquet, and "Pellet" designates the results for briquets containing dense core samples. A series of one to two dozen burn tests were completed in random fashion for each entry. The resulting standard deviations, and the relative percent improvement due to incorporation of the indicated dense core pellet are also provided.

EXAMPLE VIII

The composition of the pellets used in Example VIII, expressed as a percentage of the overall composition for the briquet, was: 98.5% non-lignite coal, 0.5% borax, and 1.0% binder.

EXAMPLE IX

The pellets used in Example IX, expressed as a percentage of the overall composition for the briquet, contained: 97.9% lignite char, 0.1% borax, and 2.0% binder.

EXAMPLE X

The composition of the pellets used in Example X, expressed as a percentage of the overall composition for the briquet, was: 90.0% coal, 6.0% sawdust, 0.5% borax and 3.5% binder.

EXAMPLE XI

The composition of the pellets used in Example XI, expressed as a percentage of the overall composition for the briquet, was: 90.0% coal, 6.0% sawdust, 0.5% borax, 2.0% nitrate and 1.5% binder.

TABLE IV

Results of Burn Tests for Briquets With & Without Pellets of Different Compositions

| | | AC (%) | | | AT (min.) | | | TTH (min.) | | |
|---|---|---|---|---|---|---|---|---|---|---|
| Example No.[a] | Sample No.[b] | Control[c] | Pellet[d] | Improvement (%)[e] | Control[c] | Pellet[d] | Improvement (%)[e] | Control[c] | Pellet[d] | Improvement (%)[e] |
| VIII | 1 | 31.2 ±5.0 | 40.9 ±10.4 | (30) | | | | | | |
| VIII | 2 | 26.7 ±4.5 | 33.8 ±4.3 | (27) | | | | | | |
| IX | 1 | 37.8 ±6.2 | 47.4 ±8.5 | (25) | | | | 16.0 ±3.6 | 12.2 ±2.1 | (24) |
| IX | 2 | 32.1 ±5.0 | 36.1 ±7.1 | (13) | | | | 17.5 ±2.6 | 15.3 ±2.8 | (13) |
| X | 1 | 31.2 ±5.0 | 42.6 ±7.2 | (37) | 19.5 ±2.1 | 16.8 ±2.5 | (14) | 15.5 ±2.5 | 10.9 1.7 | (30) |
| X | 2 | 26.7 ±4.5 | 40.7 ±6.5 | (52) | 22.7 ±2.8 | 17.5 ±2.6 | (28) | 21.4 ±4.2 | 12.5 ±2.2 | (42) |
| XI | 1 | 31.2 ±5.0 | 46.2 ±7.4 | (48) | 19.5 ±2.1 | 15.4 ±1.8 | (21) | 15.5 ±2.5 | 11.1 ±2.2 | (28) |

[a]Composition of pellets is given above for the different samples tested.
[b]Samples designated (1) were produced in a pre-manufacturing facility; samples designated (2) were produced in a manufacturing facility.
[c]"Control" samples were homogeneous briquets with no dense core pellets included.
[d]"Pellet" samples were briquets that included a dense core pellet of the indicated composition.
[e]The "improvement" was calculated as the percent absolute difference in control v. pellet, divided by control.

The data in Table IV reveal that by changing the distribution of briquet ingredients, such as by pelletizing or otherwise creating regions of different densities, it is possible to achieve an improvement of at least 10% in burn characteristics as compared to a homogeneous, or "control" briquet formulation. Here, improvements in burn characteristics pertain either to increased amounts of visual percent ash (AC) or shorter times for ash time (AT) and time to heat (TTH). With reference to Table IV once more, it was even possible to observe changes as high as 20%, 30% and even over 50% improvement in certain instances. It is also interesting to note that the use of non-lignite coal (Example VIII) provided even greater improvement in performance characteristics than were observed for control and pelletized briquets that were prepared with lignite char (Example IX). The inclusion of additional ingredients in the pellet composition also served to enhance burn performance, as indicated in Example X, which contained coal and sawdust, and Example XI, which also contained nitrate in addition to the same amounts of coal and sawdust as in Example X. The data in Table IV thus suggest that by varying the composition of pellets incorporated into a dense core briquet, different characteristics in burn performance may be realized as compared to prior art briquets which contain a homogeneous mixture of raw materials. According to one embodiment of the present invention, a preferred composition for a dense core briquet may thus contain pellets having compositions consistent with the values shown in Table V below.

TABLE V

Preferred Pellet Composition

| Raw Material | (Wt. %) |
|---|---|
| Coat | 88.0–99.0 |
| Sawdust | 3.0–9.0 |
| Starch | 1.0–3.0 |
| Nitrate | 0.0–5.0 |
| Borax | 0.0–0.5 |

EXAMPLE XII

A residue test was developed for measurement of the amount of residue that might remain after cooking was completed and after complete burn-out of briquets both with and without coal pellets of varying composition. Thus, briquets were weighed prior to burn and residues were weighed and sized both at the end of burn tests as well as several hours thereafter. The results revealed that there are essentially no residue issues for dense core briquets prepared with or without additives in the pellets, i.e., raw materials or ingredients other than coal.

It will be understood that various other changes of the details or components and uses which have been described herein and illustrated in order to explain the nature of the invention will occur to and may be made by those skilled in the art upon a reading of this disclosure, and such changes are intended to be included within the principle and scope of this invention. The invention is further defined without limitation of scope or of equivalents by the claims which follow.

What is claimed is:

1. A briquet or other solid fuel composition for barbecue cooking, comprised of a densified coal portion having a first density in combination with a wood char portion having a second density wherein the coal and wood char portions are comprised of the same materials which differ only in their relative distribution, and the first density is greater than the second density, characterized by a shorter ash time and a longer cook time than a conventional briquet having similar total composition, configuration and weight but that has no regions of different density or relative distribution of materials.

2. A charcoal briquet or other solid fuel composition in briquet form exhibiting improved ignition and burn phase characteristics, especially for use in barbecue cooking, that includes a first region comprising a densified coal portion having a first material distribution and a first density and a second region comprising a wood char portion having a second material distribution and a second density within which the coal portion is distributed, wherein the first density is greater than the second density, and the coal portion and the wood char portion together constitute the total composition of the briquet which is unchanged from a briquet of similar composition having no regions of different densities or material distribution.

3. The briquet of claim 2, wherein the densified coal portion comprises at least one pellet.

4. The briquet of claim 2 characterized by a shorter ash time and a longer cook time than a conventional briquet having similar total composition, configuration and weight but that has no regions of different densities or material distribution.

5. The charcoal briquet of claim 2 wherein the ash time is less than 25 minutes and the cook time is greater than 35 minutes.

6. A method for forming a dense core charcoal briquet from a discrete set of raw materials that exhibits improved ignition and burn phase characteristics, comprising the steps of:

(a) forming a densified coal portion from a first portion of raw materials having a first density; and (b) combining the coal portion of step (a) with a second, remaining wood char portion of raw materials having a second density to form a briquet, wherein the first density is greater than the second density and the coal portion and the wood char portion together constitute the total composition of a briquet which is unchanged from a briquet of similar composition having no regions of different density or raw materials distribution.

7. The briquet of claim 3, wherein the densified coal portion further comprises coal in combination with binders, ignition aids, and any combination thereof.

8. The briquet of claim 7, wherein the binder is starch and the ignition aid is sawdust.

9. The method of claim 6 wherein the densified coal portion comprises at least one pellet having a first material distribution.

10. The method of claim 9 wherein the first portion of raw materials further comprises coal in combination with binders, ignition aids, and any combination thereof.

11. The method of claim 10 wherein the binder is starch and the ignition aid is sawdust.

12. A briquet produced by the method of claim 6 characterized by a shorter ash time and a longer cook time than a conventional briquet having similar total composition, configuration and weight but that has no regions of different density or raw material distribution.

13. The briquet of claim 1 wherein the ash time is less than 25 minutes and the cook time is greater than 35 minutes.

14. The method for forming a dense core charcoal briquet of claim 6 wherein the ash time is less than 25 minutes and the cook time is greater than 35 minutes.

* * * * *